US006763980B2

(12) United States Patent
Godwin et al.

(10) Patent No.: US 6,763,980 B2
(45) Date of Patent: Jul. 20, 2004

(54) CONTAINER CLOSURE AND POURING APPARATUS

(75) Inventors: Ronald L. Godwin, Juno Beach, FL (US); David J. Carson, Stuart, FL (US)

(73) Assignee: Avik Corporation, Juno Beach, FL (US)

( * ) Notice: Subject to any disclaimer, the term of this patent is extended or adjusted under 35 U.S.C. 154(b) by 27 days.

(21) Appl. No.: 10/164,033

(22) Filed: Jun. 5, 2002

(65) Prior Publication Data

US 2003/0226860 A1 Dec. 11, 2003

(51) Int. Cl.[7] ..... B67D 47/00
(52) U.S. Cl. ..... 222/553; 222/74
(58) Field of Search ..... 222/74, 525, 546, 222/550, 553, 568, 570

(56) References Cited

U.S. PATENT DOCUMENTS

| | | | | | |
|---|---|---|---|---|---|
| 1,745,382 | A | * | 2/1930 | Rogers | 222/525 |
| 2,775,369 | A | | 12/1956 | Waite | 222/92 |
| 2,901,153 | A | | 8/1959 | Collins | 222/525 |
| 2,969,168 | A | * | 1/1961 | Newby | 222/525 |
| 2,992,761 | A | * | 7/1961 | Sommers, Sr. | 222/479 |
| 3,294,294 | A | | 12/1966 | Amburgey | 222/525 |
| 3,777,936 | A | * | 12/1973 | Hazard | 222/48 |
| 3,828,981 | A | | 8/1974 | Linkletter | 222/153 |
| 3,884,390 | A | | 5/1975 | Hazard | 222/149 |
| 3,908,958 | A | | 9/1975 | Linkletter | 251/95 |
| 4,129,236 | A | | 12/1978 | Wrycraft et al. | 222/570 |
| 4,802,610 | A | | 2/1989 | Cheek et al. | 222/481.5 |
| 4,979,655 | A | | 12/1990 | Gallucci | 222/519 |
| 5,197,634 | A | | 3/1993 | Beck | 222/109 |

* cited by examiner

*Primary Examiner*—Gene Mancene
*Assistant Examiner*—Melvin A. Cartagena
(74) *Attorney, Agent, or Firm*—Diederiks & Whitelaw, PLC

(57) ABSTRACT

A container closure and pouring device comprises a cap with a hollow interior defined by a cylindrical wall having internal threads and a number of inlet ports. The cap receives a spout formed with external threads which is movable between a closed position in which it seals the inlet ports and is threaded into engagement with the cap, and an open position wherein the inlet ports of the cap are uncovered allowing liquid from a container to pass into the spout for pouring.

20 Claims, 5 Drawing Sheets

CONTAINER CLOSURE AND POURING APPARATUS

FIELD OF THE INVENTION

This invention relates to container closures, and, more particularly, to an apparatus for sealing a container which includes a spout movable between a closed, sealing position and an open pouring position in which the spout is extended and rotatable to facilitate pouring of the contents of the container into a receptacle.

BACKGROUND OF THE INVENTION

A variety of containers are used to store liquids which must be poured into hard-to-reach places. This is particularly true in the automotive industry where motor oil, transmission fluid, brake fluid, coolant and the like must be periodically added or changed. Often, the inlet openings in the vehicle for the addition of these fluids are placed in locations which make it difficult to pour the contents of the container without spillage.

Containers for automotive fluids such as oil and the like have evolved from generally cylindrical-shaped metal cans to thinner plastic containers, some of which have an elongated neck. The cylindrical cans typically are used with a funnel to permit pouring of their contents into a vehicle engine, and such cans cannot be resealed after use. In many instances, the funnels cannot be independently supported within a given inlet opening, making it necessary to hold the funnel with one hand and pour with the other. After use, the funnel must be thoroughly cleaned to avoid contamination when used again with another fluid.

As noted above, plastic containers with an elongated neck portion have steadily replaced metal cans and other types of containers for automotive and other fluids. Such containers are relatively thin to make them easier to grasp and hold on to even if some of the fluid drips out on the sides of the container and causes the outer surface to be slippery. The elongated neck provides a gap between the liquid in the container and its discharge outlet, thus allowing the container to be tipped at different angles to some extent before the fluid inside begins to flow from the container. This is true even if the container is completely full when the pouring begins.

Although easier to use than metal cans, plastic containers with an elongated neck have disadvantages. In order to hold a standard quantity of liquid, e.g. a quart or liter, while maintaining a relatively thin profile or depth for ease of handling, plastic containers are typically relatively wide and tall. This configuration either limits the areas or open spaces in the engine compartment of a vehicle within which the container can be held in a position to pour the liquid, or restricts manipulation of the container once it is located near an inlet opening for the liquid. The neck of the container is integrally formed with the container body and cannot be rotated, extended or otherwise manipulated to align with an inlet opening once the container is in the pouring position. Consequently, it is often necessary to employ a funnel even with plastic containers of this type.

These problems have been addressed to some extent in pour spouts of the type disclosed, for example, in U.S. Pat. No. 4,802,610 to Cheek et al. This patent teaches a pour spout which is adapted to thread onto external threads formed near the mouth of a container where a cap is conventionally attached. The pour spout comprises a body portion insertable within the interior of the container, and a conduit which is movable between an open position and a closed position with respect to the body portion. In the closed position, the conduit is seated within the interior of the body portion to seal inlet openings formed therein and prevent the escape of liquid from the interior of the container. The conduit is pulled outwardly from the interior of the body portion to uncover the inlet openings and permit the flow of liquid from the interior of the container, through the body portion and then out the conduit. In the open position, the conduit is rotatable with respect to the body portion so that it can be positioned as desired without further manipulation of the location of the container.

One disadvantage of pour spouts of the type disclosed in the Cheek et al patent is that there is no positive connection between the conduit and the body portion. The conduit is at all times slidable relative to the body portion to the open position. As a practical matter, it is likely that one using the container will have a tendency to pick it up by the conduit thus causing it to slide to an open position before the user is ready to pour from the container, which can damage the conduit and/or result in leakage of the liquid within the container. Furthermore, if the conduit and body portion are not fully seated during shipment or storage leakage can occur. There is no way to visually determine if the conduit is completely seated within the body portion, and therefore the contents of the container may be exposed to air, contaminants or subject to leakage without the knowledge of the user.

SUMMARY OF THE INVENTION

It is therefore among the objectives of this invention to provide a container closure and pouring device which is useful with a variety of containers, which provides an effective seal in both the open and the closed positions, which resists inadvertent movement from the closed position to the open position, which can be manipulated in the open position to aid in pouring the contents of the container and which is inexpensive to manufacture.

These objectives are accomplished in a container closure and pouring device comprising a cap with a hollow interior defined by a cylindrical wall having internal threads and a number of inlet ports. The cap receives a spout formed with external threads which is movable between a closed position in which it seals the inlet ports and is threaded into engagement with the cap, and an open position wherein the inlet ports of the cap are uncovered allowing liquid from a container to pass into the spout for pouring.

An important aspect of this invention is the provision of a threaded connection between the cap and the spout in the closed position of the spout. Unlike designs of the type disclosed in U.S. Pat. No. 4,802,610 discussed above, the threaded connection between the cap and spout protects the spout from damage and ensures that a seal is maintained even if the container to which the device of this invention is attached is picked up by the spout or the spout is otherwise contacted during shipment or the like. Without the threaded connection between the spout and cap, it is difficult to determine if the spout is in a seated, sealed position with respect to the cap. If a good seal is not maintained during shipment and storage of the container, air, dirt and other contaminants may be allowed to pass into the contents of the container, and/or the container could leak.

In the presently preferred embodiment, the cap and spout are formed with complimentary seals which engage one another in both the open and closed positions of the spout. In the open position, the spout is freely rotatable with respect to the cap so that it can be manipulated into alignment with wherever the contents of the container are to be poured. An extension can be attached to the outlet end of the spout, if desired.

The cap is preferably integrally formed with a skirt which extends radially outwardly from the cylindrical wall of the cap and is formed with internal threads. The skirt is threaded onto the external threads at the neck of the container so that the cap extends into the interior thereof. Flow of liquid from the interior of the container therefore moves along a flow path defined by the inlet ports of the cap and the interior of the spout.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE PREFERRED EMBODIMENT

Figure 3:
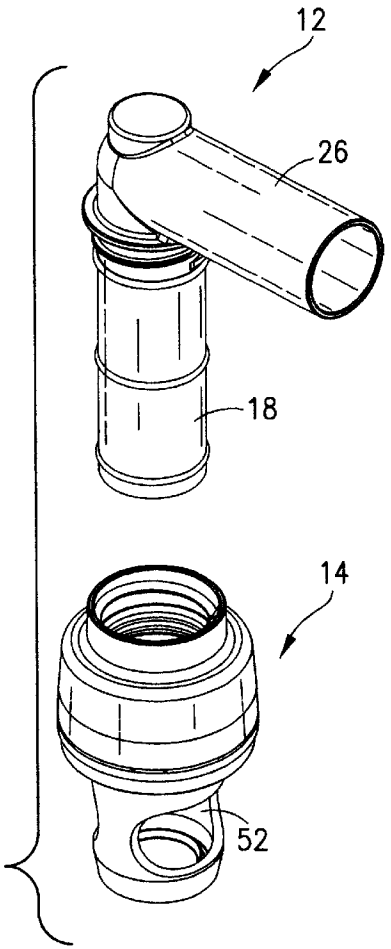
FIG. 3 is a disassembled perspective view of the spout and cap.
Figure 2:
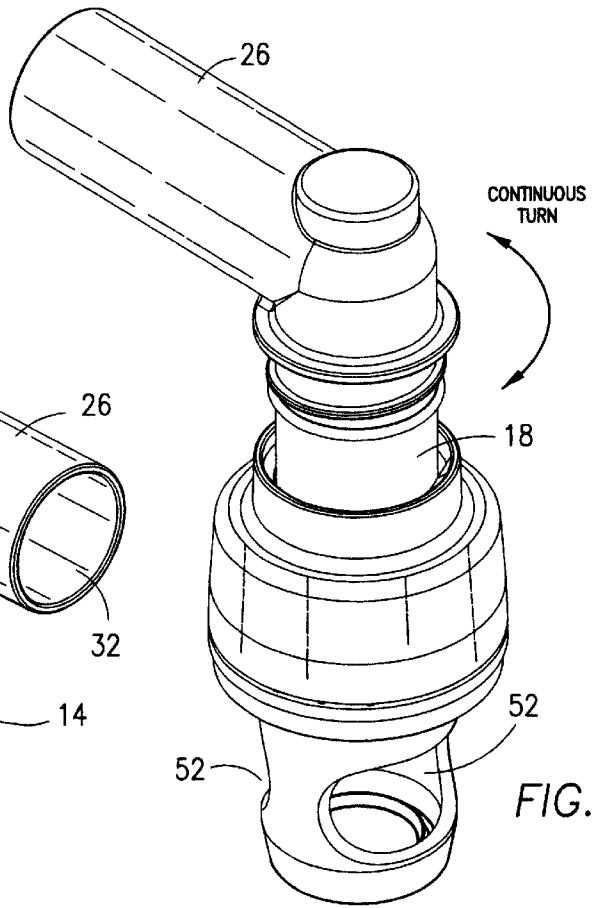
FIG. 2 is a view similar to FIG. 1 except with the spout in an open position.
Figure 1:
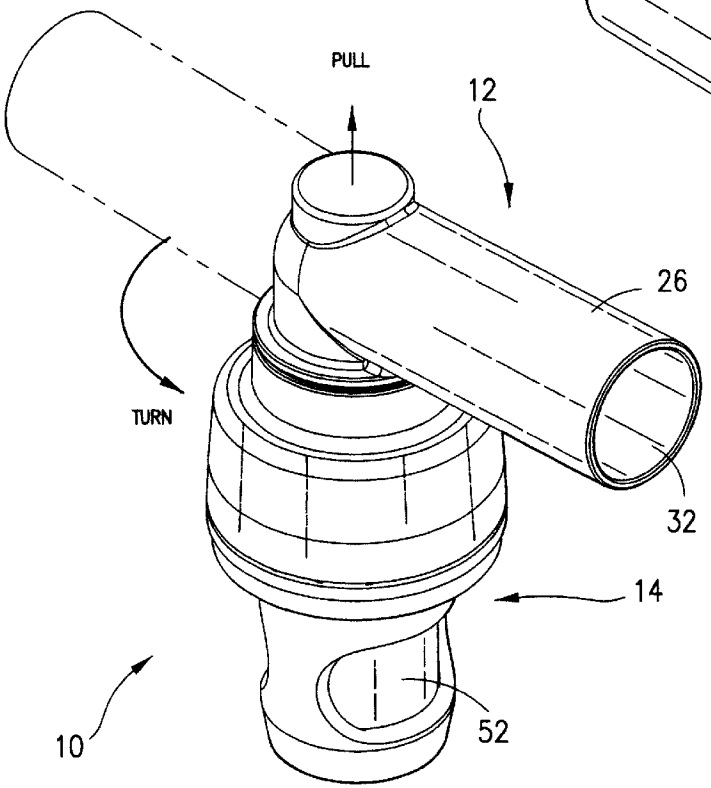
FIG. 1 is an assembled, perspective view of the spout and cap with the spout in the closed position.

Referring initially to FIGS. 1–5, the closure and pouring device 10 of this invention comprises a spout 12 and cap 14 which are removably connected to one another and assembled as a unit to the neck of a container 16, as described below. See also FIG. 8. For purposes of the present discussion, the term "vertical" is meant to refer to the orientation of the spout 12 and cap 14 as depicted in the Figs., while "upper," "lower," "top" and "bottom" refer to positions relative to vertical. The term "horizontal" refers to the orientation perpendicular to vertical as the spout 12 and cap 14 are shown in the Figs.

In the presently preferred embodiment, the spout 12 includes a vertical tube 18 having a cylindrical wall 20 forming a hollow interior 22 with an inlet end 24. The vertical tube 18 is connected to a horizontally oriented, pouring section 26 having a wall 28 forming a hollow interior 30 with an outlet or discharge end 32. The hollow interiors 22, 30 of the vertical tube 18 and pouring section 26, respectively, collectively form a flow path for the passage of liquid from the container 16, as discussed below. Preferably, the inner surface 34 of the wall 28 of the pouring section 26 is angled slightly more than 90° relative to vertical so that any liquid remaining within the pouring section 26 after a pouring operation is completed flows in a direction toward the vertical tube 18 instead of dripping from the discharge end 32.

The wall 20 of the vertical tube 18 is formed with a number of sealing members which cooperate with seals formed in the cap 14 to seal the contents of the container 16, as described below with reference to a discussion of FIGS. 6 and 7. The bottom portion of the wall 20 includes a bottom surface 36, an inner edge 38 and an outer edge 40. A lower ridge seal 42 extends radially outwardly from the wall 20 near the bottom portion of the vertical tube 18, and a second, upper ridge seal 44 is located vertically above the lower ridge seal 42. In the presently preferred embodiment, external threads 46 are formed on the wall 20 near the upper portion of the vertical tube 18, and a stop 48 is extends from the wall 20 at its juncture with the pouring section 26.

Figure 5:
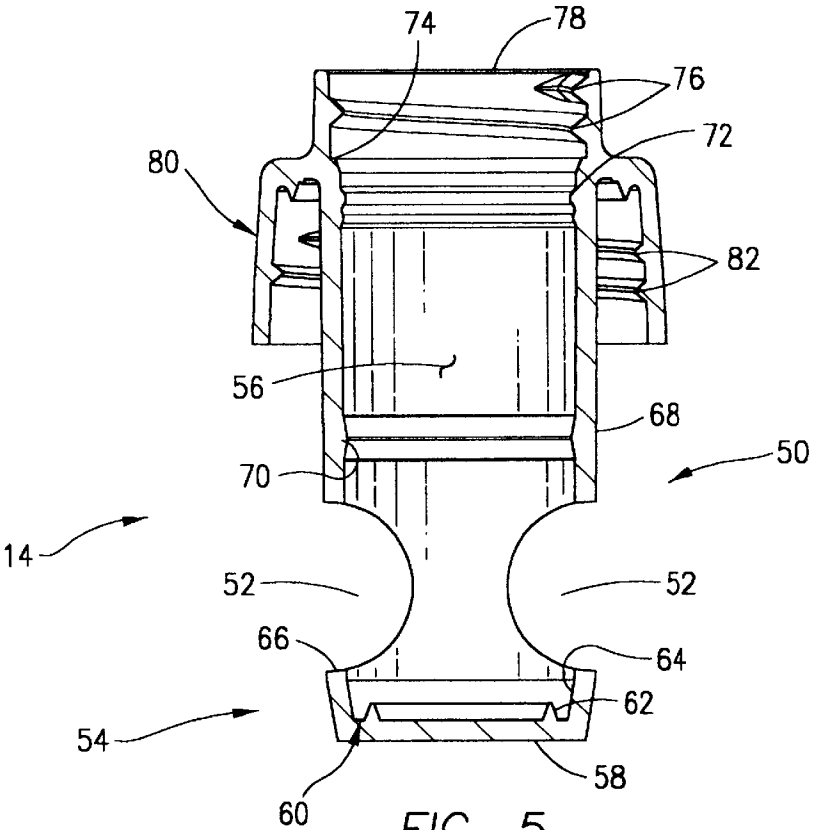
FIG. 5 is a cross sectional view of the cap.
Figure 4:
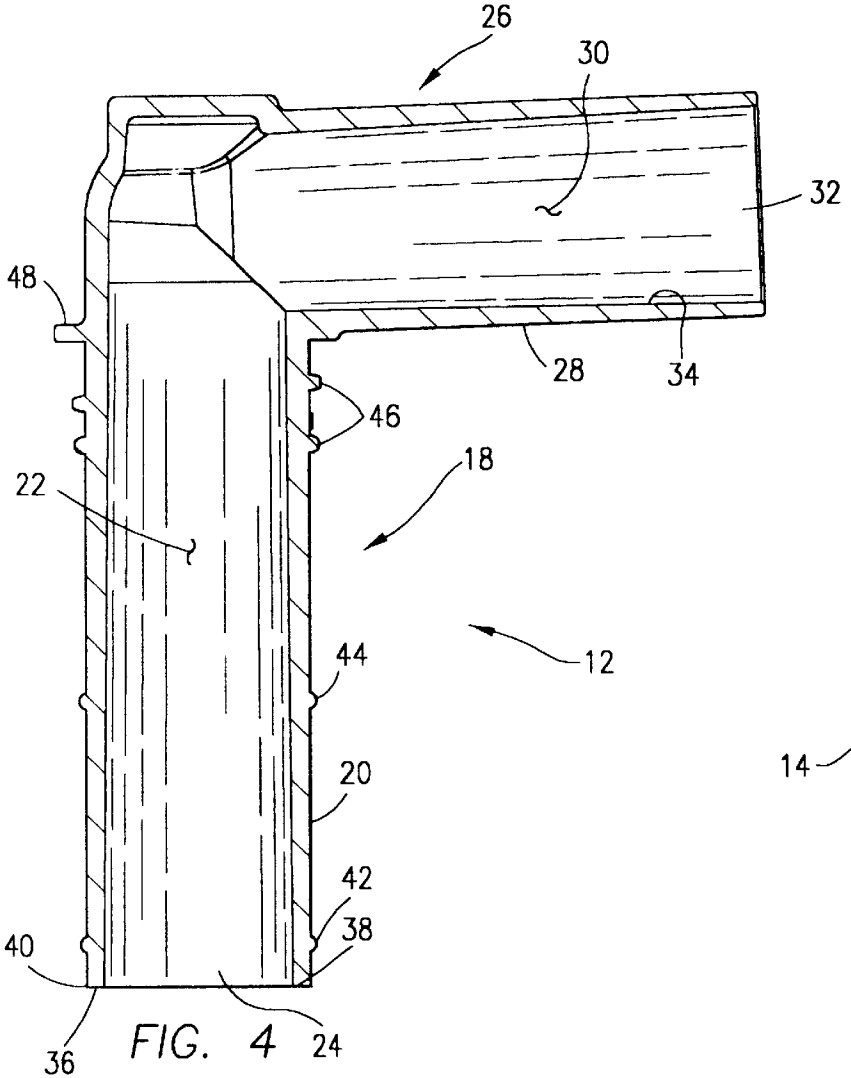
FIG. 4 is a cross sectional view of the spout.
Figure 8:
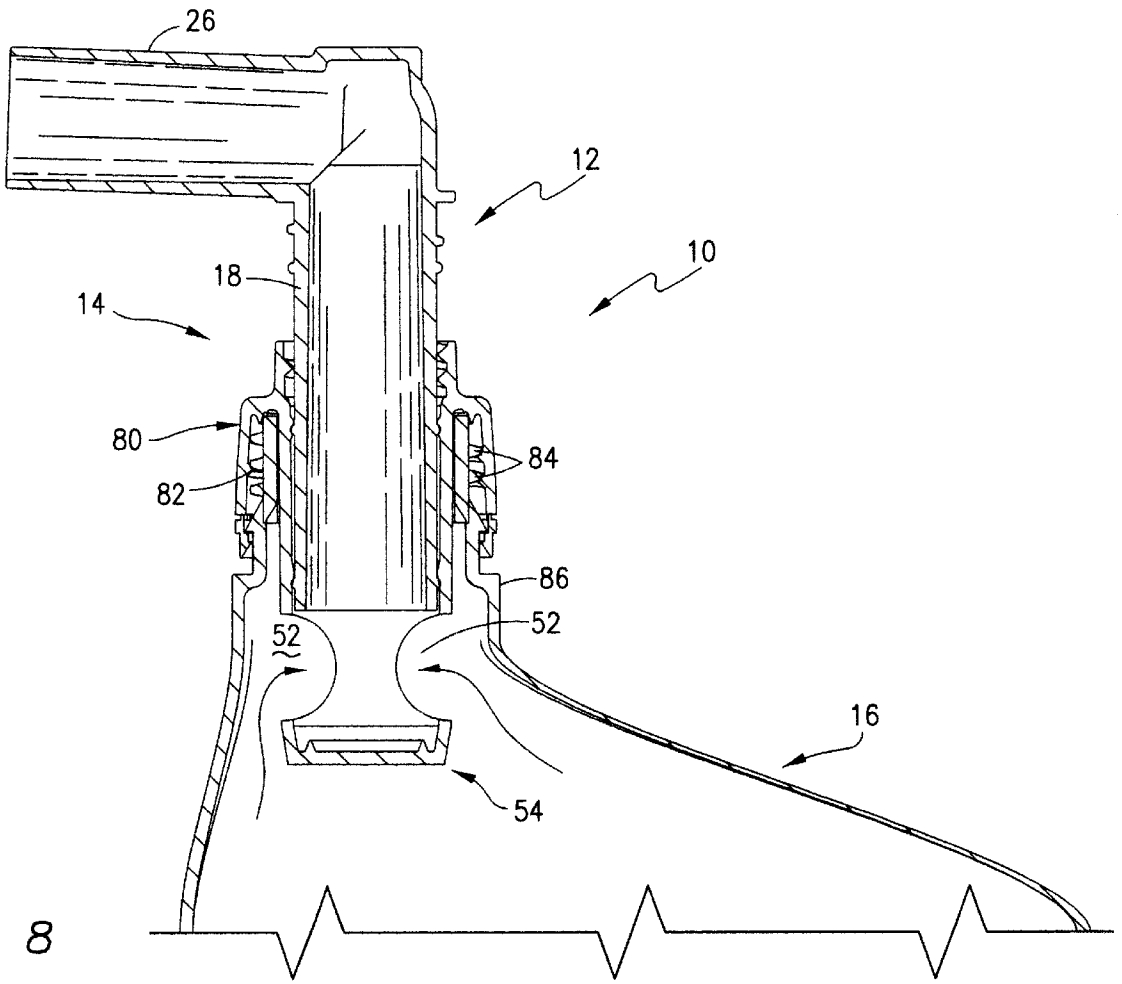
FIG. 8 is a view similar to FIG. 7 except with the device of this invention mounted to a container.

Referring now to FIG. 5, the cap 14 includes a body portion 50 formed with at least two inlet ports 52 near its lower end 54 which extend into a hollow interior 56. The lower end 54 is closed by a base 58 which is formed with a seat 60 having an inner wall 62 and an outer wall 64 terminating at a top edge 66. The inner and outer walls 62, 64 are tapered and angle away from one another, as shown. The body portion 50 has a wall 68 located above the inlet ports 52 which is formed with a radially inwardly extending ramp seal 70, a stop seal 72, a tapered surface 74 and internal threads 76 adjacent the upper, open end 78 of the cap 14. In the presently preferred embodiment, a skirt 80 is integrally formed with the wall 68 of body portion 50. The skirt 80 extends from the upper portion of the wall 68, and then downwardly toward the lower end 54 with a radial space being formed between the skirt 80 and wall 68. The skirt 80 is formed with internal threads 82 which are adapted to mate with external threads 84 formed on the neck 86 of the container 16 as best seen in FIG. 8.

Figures 6, 6A, 6B, 6C, 7, 7A, 7B:
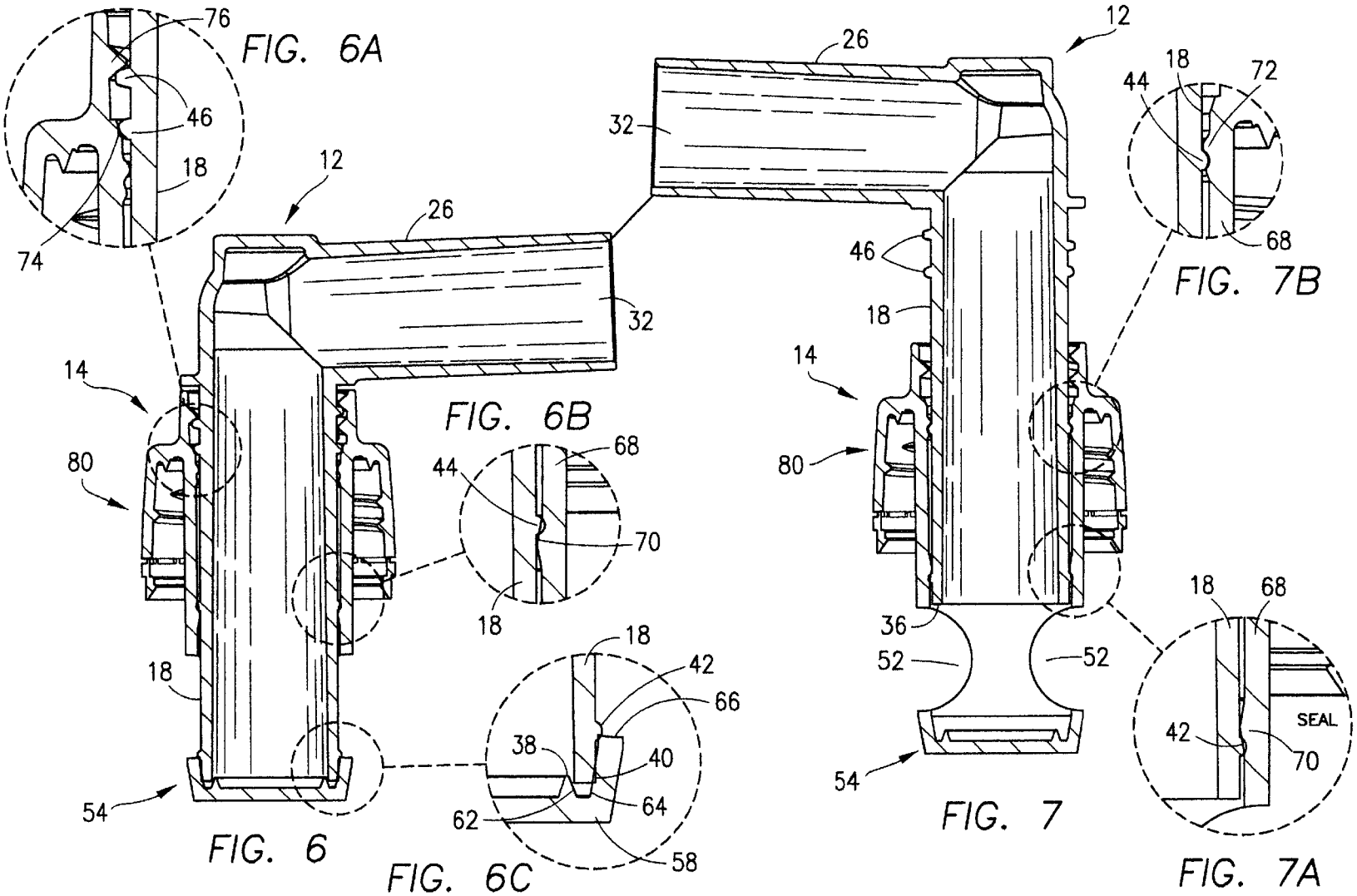
FIG. 6 is a cross sectional view of the assembled cap and spout, with the spout in a closed position.
FIG. 6A is a enlarged cross sectional view of an encircled portion of FIG. 6 depicting one seal between the spout and cap.
FIG. 6B is an enlarged cross sectional view of an encircled portion of FIG. 6 showing one of the seals between the cap and spout.
FIG. 6C is an enlarged cross sectional view of an encircled portion of FIG. 6 showing the bottom portion of the spout seated at the base of the cap.
FIG. 7 is a view similar to FIG. 6, except with the spout in the extended, open position.
FIG. 7A is an enlarged cross sectional view of an encircled portion of FIG. 7 showing a seal between the cap and spout with the spout in the open position.
FIG. 7B is an enlarged cross sectional view of an encircled portion of FIG. 7 showing another seal between the cap and spout, with the spout in the open position.

Referring now to FIGS. 6–7B, the spout 12 and cap 14 are shown assembled together, first in the closed position (FIG. 6) and then the open position (FIG. 7). Initially, the spout 12 and cap 14 are interconnected by inserting the vertical tube 18 of spout 12 into the open end 78 of the body portion 50 of cap 14. In the closed position depicted in FIGS. 6–6C, the bottom portion of the vertical tube 18 extends all the way to the lower end 54 of the cap 14 and the uppermost end of the cap 14 engages the stop 48 on the vertical tube 18 of the spout 12.

A number of seals are created between the spout 12 and cap 14 in the closed position shown in FIG. 6. As best seen in FIG. 6C, a multi-surface seal is created between the bottom portion of the vertical tube 18 and the lower end 54 of cap 14. The inner edge 38 of vertical tube 18 contacts the inner wall 62 of seat 60, the outer edge 40 of vertical tube 18 engages the outer wall 64 of seat 60 and the lower ridge seal 42 rests atop the top edge 66 of the outer wall 64 or cap 14. The inlet ports 52 of the cap 14 are closed by the wall 20 of vertical tube 18. As shown in FIG. 6B, the upper ridge seal 44 of the vertical tube 18 engages and seals with the ramp seal 70 of the cap 14. The lowermost external thread 46 on the vertical tube 18 seals with the tapered surface 74 located near the open end 78 of the cap 14, and seal is also created between the remaining external threads 46 of the spout 12 and the internal threads 76 of the cap 14. See FIG. 6A.

The threaded connection between the spout 12 and cap 14 is advantageous because the spout 12 is maintained in a sealed position relative to the cap 14 even if the container 16 is picked up by the spout 12 or some other force is exerted on the container 16 or vertical tube 18 of spout 12 during shipment or otherwise. The bottom portion of the spout 12 is urged into contact with the lower end 54 of the cap 14, forming the seals noted above, and is retained in that position until the spout 12 is unthreaded from the cap 14. This ensures that the wall 20 of the vertical tube 18 of the spout 12 is maintained in a closed or lowered position to cover and seal the inlet ports 52 of the cap 14, preventing leakage of the contents of container 16.

Referring now to FIGS. 7–7B, the spout 12 and cap 14 are shown in the open position. Initially, the spout 12 is unthreaded from the cap 14, and then the spout 12 is pulled vertically upwardly so that the bottom surface 36 of the vertical tube 18 clears the inlet ports 52 of the cap 14. A flow path is therefore created from the interior of the container 16, into the inlet ports 52 of the cap 14 and through the hollow interiors 22 and 30 of the vertical tube 18 and pouring section 26, respectively, of the spout 12. The spout 12 is fully rotatable relative to the cap 14, with a 360° range of motion, when in the open or extended position. See also FIG. 2.

Seals are created between the spout 12 and cap 14 when in the open position to prevent leakage of the contents of the container 16 during a pouring operation. As best seen in FIG. 7A, the lower ridge seal 42 on the wall 20 of vertical tube 18 engages and seals against the ramp seal 70 on the body portion 50 of cap 14. With reference to FIG. 7B, the upper ridge seal 44 of the vertical tube 18 seals against the "stop" seal 72 of the cap 14, which is also effective to prevent the spout 12 from further upward vertical movement so that the spout 12 and cap 14 do not become separated. The spout 12 is returned to the closed position by moving it vertically downwardly within the cap 14, as described in connection with a discussion of FIG. 6, and threading the two members together.

Figure 9:
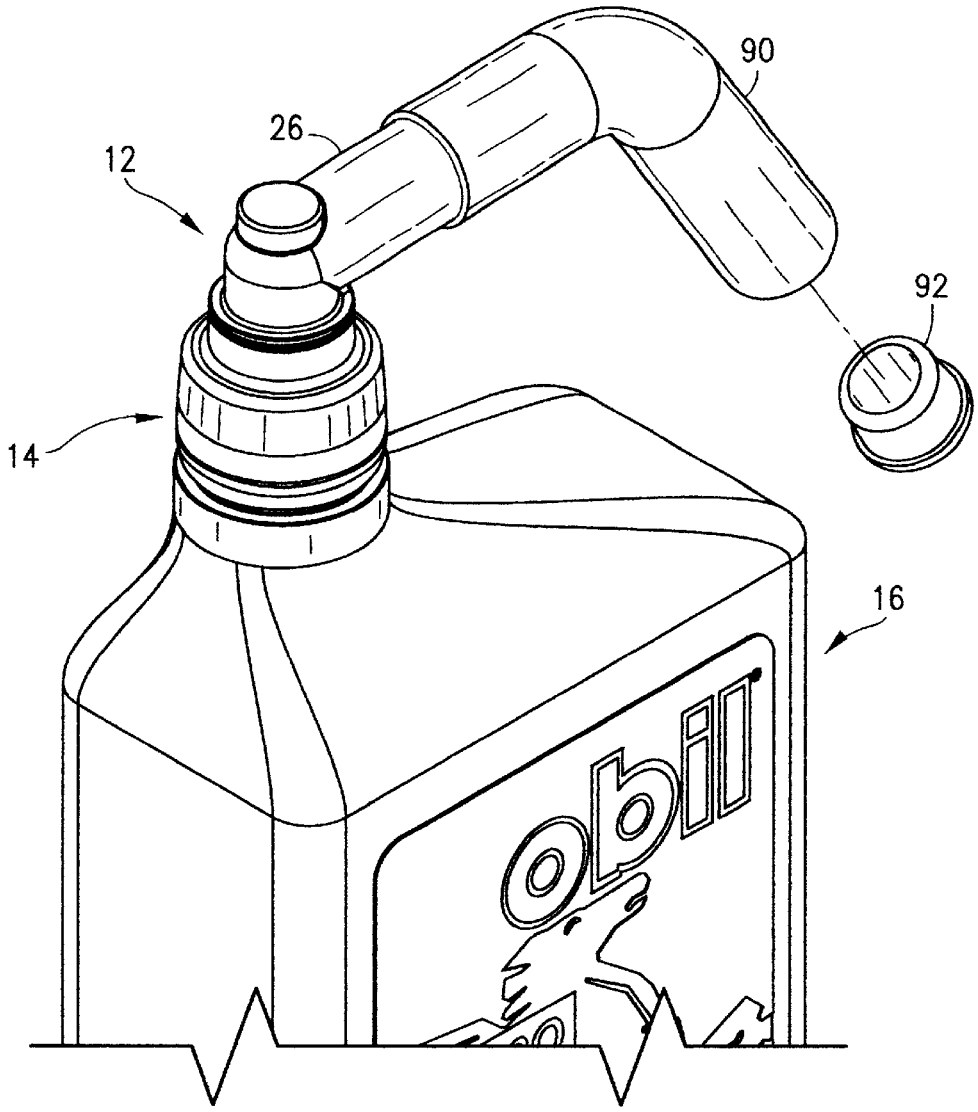
FIG. 9 is a perspective view of a portion of the assembled cap and spout with an extension mounted to the spout.

As noted above, the spout 12 freely rotates relative to the cap 14 and container 16 in the open position. This allows the discharge end 32 of the pouring section 26 of the spout 12 to be placed in the desired position relative to a receptacle for the contents of the container 16. In the particular application where the container 16 is filled with motor oil, manipulation of the spout 12 is advantageous since the fill hole for the oil is often placed in a hard-to-reach location in many types of engines. As shown in FIG. 9, an extension 90 may be attached to the pouring section 26 of the spout 12 to further assist in the pouring operation. The extension 90 preferably includes a cap 92 to close it for storage of the container 16.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A container closure and pouring apparatus, comprising:

a cap including a cylindrical wall having a hollow interior, a first, open end and a second, closed end, said cylindrical wall being formed with at least one inlet port extending into said hollow interior and internal threads, said cap being adapted to mount to a container, wherein said second, closed end of said cap is formed with a base having a seat, said seat having inner and outer walls which taper outwardly and away from one another in a direction from said base toward said first, open end, said outer wall terminating in a top edge;

a spout including a tubular section connected to a pouring section which collectively form a flow path for the passage of liquid, said tubular section being insertable within said first, open end of said cap and being movable between a closed position in which said tubular section closes said at least one inlet port in said cap and an open position in which said at least one inlet port is uncovered, said tubular section of said spout being formed with external threads which mate with said internal threads of said cylindrical wall of said cap to releaseably interconnect said cap and said spout with said spout in the closed position, wherein said tubular section of said spout includes a bottom portion formed with a bottom surface, an inner edge and an outer edge, said tubular section being formed with a radially outwardly extending first ridge seal spaced from said bottom surface, whereby in the closed position of said spout said inner edge seals against said inner wall of said seat of said cap, said outer edge seals against said outer wall of said seat and said first ridge seal forms a seal against said top edge of said outer wall and wherein said tubular section of said spout is formed with a stop at the juncture of said tubular section and said pouring section, said stop being engageable with said cap in the closed position of said spout.

2. The apparatus of claim 1 in which said external threads of said spout include a lowermost thread, and said cap is formed with a taper seal adjacent said internal threads thereof, said lowermost thread of said spout contacting and sealing against said taper seal of said cap with said spout in the closed position.

3. The apparatus of claim 1 in which said tubular section of said spout is substantially vertically oriented when said cap is mounted to a container, said pouring section of said spout being disposed at an angle in excess of 90° relative to said vertically oriented tubular section.

4. A container closure and pouring apparatus, comprising:

a cap including a cylindrical wall having a hollow interior, a first, open end and a second, closed end, said cylindrical wall being formed with at least one inlet port extending into said hollow interior and internal threads, said cap being adapted to mount to a container, wherein said second, closed end of said cap is formed with a base having a seat, said seat having inner and outer walls which taper outwardly and away from one another in a direction from said base toward said first, open end, said outer wall terminating in a top edge;

a spout including a tubular section connected to a pouring section which collectively form a flow path for the passage of liquid, said tubular section being insertable within said first, open end of said cap and being movable between a closed position in which said tubular section closes said at least one inlet port in said cap and an open position in which said at least one inlet port is uncovered, said tubular section of said spout being formed with external threads which mate with said internal threads of said cylindrical wall of said cap to releaseably interconnect said cap and said spout with said spout in the closed position, wherein said tubular section of said spout includes a bottom portion formed with a bottom surface, an inner edge and an outer edge, said tubular section being formed with a radially outwardly extending first ridge seal spaced from said bottom surface and a second ridge seal spaced between said first ridge seal and said external threads, whereby in the closed position of said spout said inner edge seals against said inner wall of said seat of said cap, said outer edge seals against said outer wall of said seat and said first ridge seal forms a seal against said top edge of said outer wall.

5. The apparatus of claim 4 in which said cylindrical wall of said cap is formed with a ramp seal and a spaced, stop seal, each of said ramp seal and said stop seal extending radially inwardly from said cylindrical wall into said hollow interior.

6. The apparatus of claim 5 in which said second ridge seal of said spout is formed to engage and seal with said ramp seal of said cap when said spout is in the closed position.

7. The apparatus of claim 5 in which said first ridge seal of said spout is formed to engage and seal with said ramp seal of said cap when said spout is in the open position.

8. The apparatus of claim 5 in which said second ridge seal of said spout is formed to engage and seal with said stop of said cap when said spout is in the open position, said stop seal preventing disengagement of said spout from said cap while permitting rotational movement therebetween.

9. The apparatus of claim 4 in which said tubular section of said spout is formed with a stop at the juncture of said tubular section and said pouring section, said stop being engageable with said cap in the closed position of said spout.

10. A container closure and pouring apparatus, comprising:

a cap including a cylindrical wall having a hollow interior, internal threads and at least one inlet port extending through said cylindrical wall to said hollow interior, said cap having a skirt extending radially outwardly from said cylindrical wall, said skirt being formed with internal threads adapted to mate with external threads of a container;

a spout having a tubular section connected to a pouring section, said tubular section being insertable within said hollow interior of said cap and movable between an open position in which said spout is rotatable relative to said cap through 360° and said at least one inlet port in said cap is uncovered by said spout and a closed position in which said spout covers said at least one inlet port, said tubular section of said spout being formed with external threads which mate with said internal threads of said cylindrical wall to releasably interconnect said cap and spout with said spout in the closed position and which are completely disengaged from said internal threads when said spout is in the open position.

11. The apparatus of claim 10 in which said second, closed end of said cap is formed with a base having a seat, said seat having inner and outer walls which taper outwardly and away from one another in a direction from said base toward said first, open end, said outer wall terminating in a top edge.

12. The apparatus of claim 11 in which said tubular section of said spout includes a bottom portion formed with a bottom surface, an inner edge and an outer edge, said tubular section being formed with a radially outwardly extending first ridge seal spaced from said bottom surface, whereby in the closed position of said spout said inner edge seals against said inner wall of said seat of said cap, said outer edge seals against said outer wall of said seat and said first ridge seal forms a seal against said top edge of said outer wall.

13. The apparatus of claim 10 in which said external threads of said spout include a lowermost thread, and said cap is formed with a taper seal adjacent said internal threads thereof, said lowermost thread of said spout contacting and sealing against said taper seal of said cap with said spout in the closed position.

14. The apparatus of claim 10 in which said tubular section of said spout is substantially vertically oriented when said cap is mounted to a container, said pouring section of said spout being disposed at an angle in excess of 90° relative to said vertically oriented tubular section.

15. The apparatus of claim 10 in which said tubular section of said spout is formed with a radially outwardly extending ridge seal.

16. The apparatus of claim 10 in which said tubular section of said spout is formed with a stop at the juncture of said tubular section and said pouring section, said stop being engageable with said cap in the closed position of said spout.

17. The apparatus of claim 10 in which said cylindrical wall of said cap is formed with a ramp seal and a spaced, stop seal, each of said ramp seal and said stop seal extending radially inwardly from said cylindrical wall into said hollow interior.

18. The apparatus of claim 10 in which said tubular section of said spout is formed with a second ridge seal spaced between said first ridge seal and said external threads, said radially outwardly extending first ridge seal spaced from said bottom surface, whereby in the closed position of said spout said inner edge seals against said inner wall of said seat of said cap, said outer edge seals against said outer wall of said seat and said first ridge seal forms a seal against said top edge of said outer wall.

19. A container closure and pouring apparatus, comprising:

a cap including a cylindrical wall having a hollow interior, internal threads and at least one inlet port extending through said cylindrical wall to said hollow interior, said cap having a skirt extending radially outwardly from said cylindrical wall, said skirt being formed with internal threads adapted to mate with external threads of a container, said cylindrical wall of said cap is formed with a ramp seal and a spaced, stop seal, each of said ramp seal and said stop seal extending radially inwardly from said cylindrical wall into said hollow interior; and a spout having a tubular section connected to a pouring section, said tubular section being insertable within said hollow interior of said cap and movable between an open position in which said spout is rotatable relative to said cap and said at least one inlet port in said cap is uncovered by said spout and a closed position in which said spout covers said at least one inlet port, said tubular section of said spout being formed with external threads, which mate with said internal threads of said cylindrical wall to releasably interconnect said cap and spout with said spout in the closed position, and a radially outwardly extending ridge seal.

20. The apparatus of claim 19 in which said ridge seal of said spout is formed to engage and seal with said stop seal of said cap with said spout in the open position, said stop seal preventing disengagement of said spout from said cap while permitting rotational movement therebetween.

* * * * *